United States Patent [19]

Jacobs

[11] 4,422,555

[45] Dec. 27, 1983

[54] RACKING

[75] Inventor: Keith R. Jacobs, Ferny Creek, Australia

[73] Assignee: Linton James Kirk, Aspendale, Australia

[21] Appl. No.: 277,342

[22] Filed: Jun. 25, 1981

[51] Int. Cl.[3] ..... A47F 7/28

[52] U.S. Cl. ..... 211/74; 211/189; D7/71

[58] Field of Search ..... D7/71; D6/186, 189; 211/74, 71, 189; 46/21, 30, 23, 31, 17

[56] References Cited

U.S. PATENT DOCUMENTS

| | | | |
|---|---|---|---|
| D. 230,932 | 3/1974 | Izumi | D7/71 |
| D. 236,411 | 8/1975 | Horney | D7/71 |
| 3,144,881 | 8/1964 | Sproull | 46/31 X |
| 4,270,662 | 6/1981 | Gonzalez | D7/71 X |

FOREIGN PATENT DOCUMENTS

| | | | |
|---|---|---|---|
| 427207 | 6/1967 | Switzerland | D7/71 |
| 20492 | of 1899 | United Kingdom | 211/74 |
| 1249387 | 10/1971 | United Kingdom | 211/74 |

*Primary Examiner*—Ramon S. Britts
*Assistant Examiner*—Robert W. Gibson, Jr.
*Attorney, Agent, or Firm*—Larson and Taylor

[57] ABSTRACT

Wine racking comprising modules of cellular enclosures defined by a honeycomb of elongate support members joined together by obliquely extending struts that locate in slots positioned adjacent the edges of the elongate support members.

11 Claims, 4 Drawing Figures

RACKING

This invention relates to racking and in particular, modular racking, for storing wine bottles.

In designing racking for the storage of wine bottles a number of important criteria has to be considered. The racking should take up as little space as possible to ensure the maximum number of bottles is stored in any particular area. It is also important that the racking is sufficiently strong to support a large number of bottles at all times. The cost effectiveness of the racking is another important consideration, particularly when there are very large numbers of bottles to be stored. It is also desirable to support the bottles in a manner that they cannot fall through the racking from one position to another.

Many rack assemblies currently on the market only fulfil a number of the above criteria and the present invention relates to an improved racking assembly, the design of which is the result of consideration of the above criteria.

According to the present invention, there is provided a modular rack for storing wind bottles comprising a honeycomb of elongate cellular enclosures each arranged to accommodate a wine bottle, the honeycomb being defined by elongate support members joined together by struts which extend between two adjacent support members and are inclined to the plane of the support members. Preferably, each support member is provided with a pair of obliquely extending slots at each end thereof into which the struts are arranged to locate. Each strut is preferably arranged to extend from the associated support member so that the struts extend divergently of the support member at an angle of 120°. A pair of opposed support members and four struts, pairs of which are joined at their ends by the edge of the support member of the adjacent enclosure are arranged to define an equally sided hexagon.

The struts may be a press-fit within the associated slots or alternatively may be glued therein.

The support members are preferably provided with a concave surface onto which the curved surface of a horizontally extending wine bottle may be laid. Each enclosure is arranged to be preferably the length of a standard wine bottle. Alternatively, the length of the enclosure can be reduced so that the neck of the wine bottle protrudes for easy access.

The present invention also includes a kit of components for assembly into a cellular structure, the components comprising a plurality of elongate support members, the longitudinal edges of which are provided with a pair of obliquely inclined slots, and a plurality of elongate support struts, each strut being arranged to be a force-fit within a slot in the support member.

The racking structure described above is preferably made of wood, although it is understood that alternative materials such as plastics may be incorporated in one or more of the components.

The invention will now be described by way of example only with reference to the accompanying drawings in which.

Figure 1:
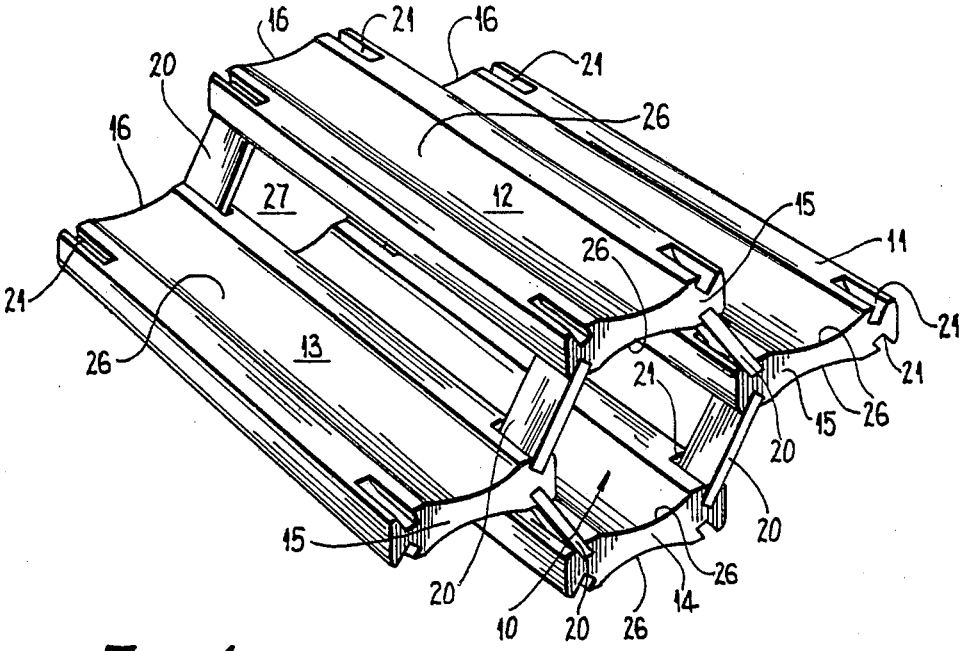
FIG. 1 is a perspective view of part of the wine racking.

The modular wine racking illustrated in the accompanying drawings is constructed of wood and in particular treated pine and is preferably arranged as a kit of parts which can be simply assembled to build wine racking of any predetermined size. The wine racking is arranged as a honeycomb of elongate cellular enclosures 10 each of which is arranged to accommodate a wine bottle. Each cellular enclosure 10 is defined by four elongate support members 11, 12, 13, 14 joined together at each end 15 and 16 by four struts 20, the struts being located in oblique slots 21 provided in the end portions of the support members. Two opposed support members 12 and 14 define the upper and lower support surfaces for a wine bottle and the lateral edge 23 of the other opposed support members 11 and 13 merely serve to locate the struts 20, the remainder of the support members 11 and 13 serving to act as the base or upper portion of adjacent cellular enclosures. The oblique slots 21 provided in the ends of each support member are arranged so that the cellular enclosure is in the form of an equally sided hexagon, that is, with the struts extended at an angle of 120° to the generally horizontal plane of the support members. The struts are comparatively thin as shown in the drawings and have a width of approximately 1 inch and can be either a press fit within the slots or glued therein.

Each support member is provided with opposed concave surfaces 26 arranged to accommodate the curved surface of the main body of a wine bottle. The support members are generally 7 inches long but may be longer if desired.

Although the struts are comparatively narrow and therefore leave long gaps 27 (FIG. 1) along the length of each cellular enclosure 10 to improve the ventilation around the racking and also the visibility of each bottle, it is understood that the struts could be replaced by elongate side members which locate in longitudinally extending oblique slots in the lateral edges of the support members.

The precise choice of the angle of the oblique slots in the support members and the use of an equally sided hexagon configuration provides a cellular enclosure which adequately supports any type of wine bottle along its whole length whilst at the same time uses the space to maximum efficiency. Furthermore the simple slotted strut arrangement provides, particularly when the racking is loaded, a very strong arrangement since the struts when under compression can withstand very heavy loads.

The components making up the racking can be simply manufactured from strips of wood, planed and cut to length to provide the concave support surfaces and chamfered edges. By use of a router the oblique slots can be simply positioned in the ends. The struts can be simply manufactured from offcuts from the support members and are of simple rectangular cross-section. Other improvements include a chamfered leading edge on the upper and lower surfaces of the support members to reduce the risk of a sharp edge tearing the label on a wine bottle.

The racking described above has the advantage that it is simple to manufacture, small, light, yet strong and capable of being simply assembled in any length or height to support a large number of wine bottles. The main body of each wine bottle is positively located by the support member and therefore the bottles cannot fall through the racking from one level to another. The ventilation and accessability of the bottles is also greatly increased due to the use of comparatively thin support struts and, where the racking is used in a retail outlet to display an assortment of wines, the customer has easy access to the bottles and can simply read the labels without having to remove the bottles from the racking.

It is envisaged that the racking described above can be either sold in completed units or sold as a kit of components for assembly by the purchaser.

Figure 4:
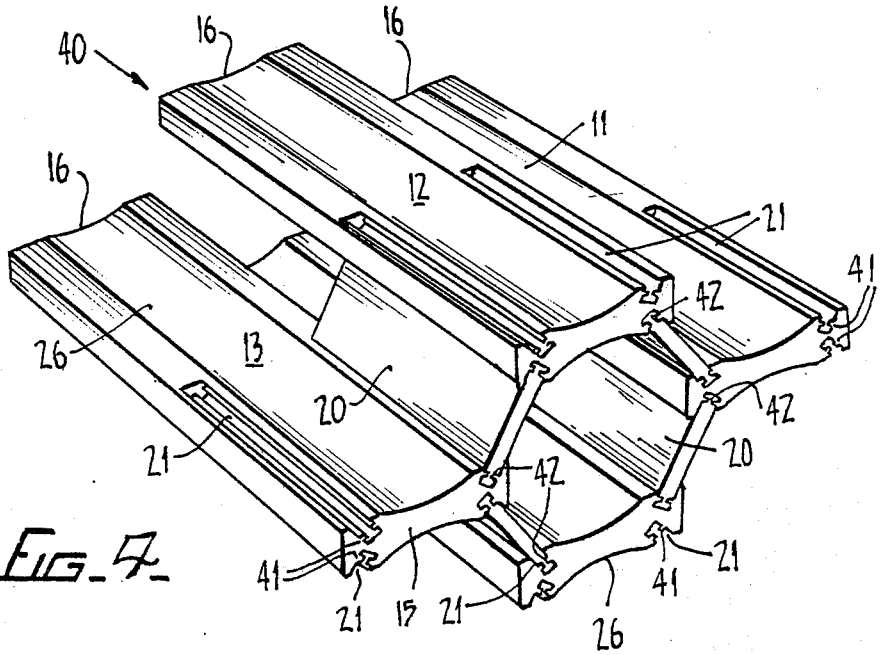
FIG. 4 is a perspective view of an alternative form of wine racking.
Figure 2:
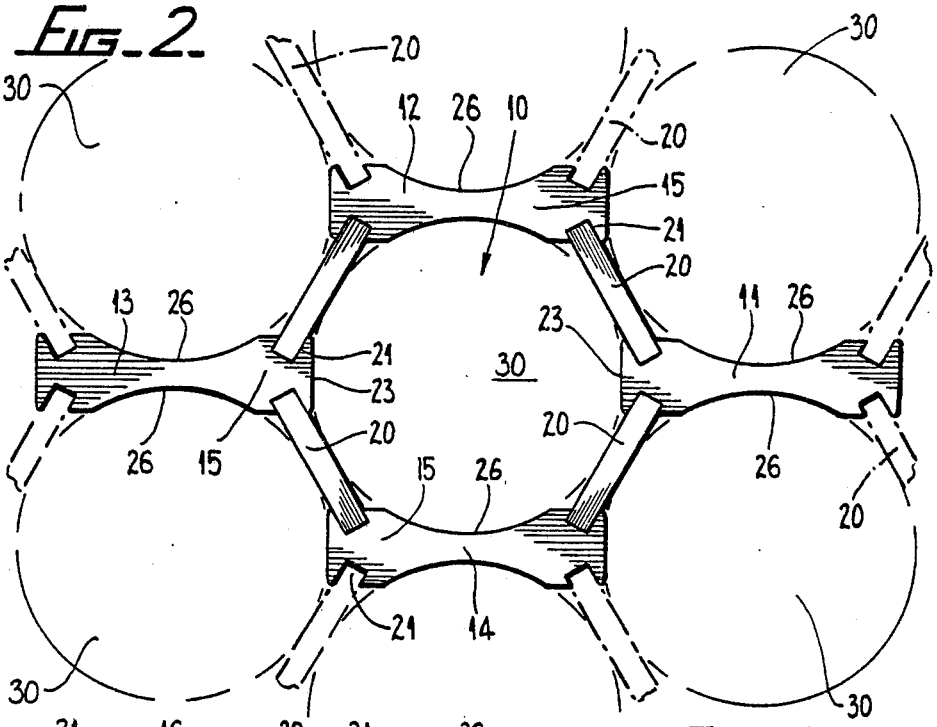
FIG. 2 is an end elevation of the wine racking
Figure 3:
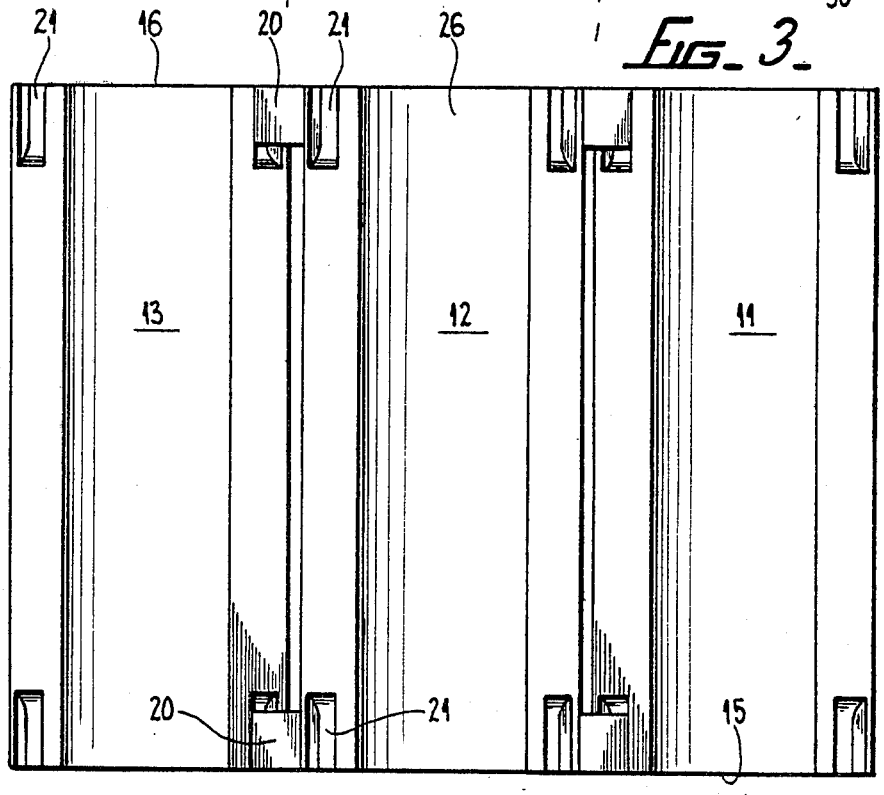
FIG. 3 is a plan view of the racking.

Another variation of the design that is considered to fall within the ambit of the invention is illustrated in FIG. 4. The width of each strut 20 and the length of the oblique slots 21 are increased by two to three times so that the struts extend approximately half-way along the length of the support member 12 at one end of the assembly. The width of the struts 20 provides adequate support for the support platforms without the need for struts at the opposite end 30 of the assembly. The additional width of the modified struts gives the racking the desired strength so that the assembly becomes simpler in construction and therefore cheaper to produce.

Furthermore, as shown in FIG. 4, the struts 20, instead of being a press or force-fit within the oblique slots 21, may be designed to be a loose-fit within the slot. Each oblique slot 21 may be routed to provide a small projection 31 on each face of the slot, the projections facing inwardly of the slots. The struts would be each provided with a transverse groove 32 extending across the width of each strut on each side and each end of the struts so that on assembly the struts are axially slit into the oblique slots 21 with the projections 31 locating in the opposed grooves 32 on the respective end of the strut. This feature provides the advantage that the struts can only be assembled or disassembled from the elongate members by a sliding movement axially of the slots. The struts cannot be removed transversely of the axis of the slots i.e. in a substantially vertical direction, so that there is no chance of the modular racking being pulled apart by vertical tensile forces. Furthermore, where additional racking should be added to an existing rack, the struts can simply be located in the respective elongate members by a sliding movement axially of the slots. This is a particular advantage where one end of the racking may be adjacent a wall and there is little access to the rear of the racking. A further advantage of this improvement is that there is no need for the struts to be a force-fit in the slots nor is there a requirement for the use of adhesives in securing the struts to the slots. Although the struts are a comparatively loose-fit within the slots, once the assembly is under load the struts go into compression thereby providing the inherent rigidity of the structure. The only means of dismantling the assembly is to remove the struts axially of the slots i.e. away from the structure.

Having now described my invention, what I claim is:

1. A modular rack for storing wine bottles comprising a honeycomb of elongate cellular enclosures each arranged to accommodate a wine bottle, the honeycomb being defined by elongate support members each of which includes an upper elongate surface and a lower elongate surface, each longitudinal edge of at least one end of the support member having formed therein a pair of obliquely extending slots, the slots opening adjacent or on the edge of said respective upper and lower surfaces, the elongate suppport members being joined together by struts which extend between two adjacent support members and have ends that locate within the slots of adjacent support members so that the struts are inclined to the plane of the support members.

2. A modular rack according to claim 1 wherein the slots are obliquely formed in each support member so that each strut extends divergently of the associated support member at an angle of 120°.

3. A modular rack according to claim 2 wherein the slots are formed in only one end of each support member.

4. A modular rack according to claim 3 wherein each slot and the width of each strut is about half the length of each support member.

5. A modular rack according to claim 1 wherein both ends of each support member are provided with a pair of obliquely extending slots opening adjacent or on each longitudinal edge of the support member.

6. A modular rack according to claim 1 wherein at at least one end of the rack, the cellular enclosure is defined by a pair of vertically spaced apart parallel support members, the lower surface of the upper member and the upper surface of the lower member having adjacent each edge a respectively downwardly or upwardly divergently extending strut, the opposite end of each strut being located in an oblique slot formed in the support members of adjacent cellular enclosures so that the upper and lower support members, the four struts and the end edges of the support members of adjacent cellular enclosures define an equally sided hexagon.

7. A modular rack according to claim 1 wherein the support members are provided with a concave surface onto which the curved surface of a horizontally extending wine bottle may be laid.

8. A modular rack according to claim 1 wherein each end of each strut is provided with a projection, the projection being arranged to engage a groove provided in the respective slot in the support member.

9. A modular rack according to claim 7 wherein each end of each strut is provided with a groove on each side thereof and each side of the slot in the support member is provided with a projection that the strut may be located within the slot by axially sliding the strut into the slot with the projections locating within the grooves to prevent displacement of the strut transversely of the axis of the slot.

10. A modular rack according to claim 1 wherein the struts are a press-fit within the slots.

11. A kit of components for assembly into a cellular structure, the components comprising a plurality of elongate support members, the longitudinal edges of which are provided with obliquely inclined slots, and a plurality of elongate support struts, each strut being arranged to locate within a slot in the support member, each end of each strut being provided with a groove on each side thereof and each side of the slot in the support member being provided with a projection so that the strut may be located within the slot by axially sliding the strut into the slot with the projections locating within the grooves to prevent displacement of the strut transversely of the axis of the slot.

* * * * *